US006354510B1

(12) United States Patent
Petersen

(10) Patent No.: US 6,354,510 B1
(45) Date of Patent: Mar. 12, 2002

(54) EXPANSION VALVE HOUSING

(75) Inventor: Hans Kurt Petersen, Kolding (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 09/764,484

(22) Filed: Jan. 12, 2001

(51) Int. Cl.[7] ..... G05D 27/00
(52) U.S. Cl. ..... 236/92 B; 62/197; 62/225
(58) Field of Search ..... 62/225, 197, 204, 62/210; 236/92 B

(56) References Cited

U.S. PATENT DOCUMENTS

| | | | | | |
|---|---|---|---|---|---|
| 2,702,723 | A | * | 2/1955 | MacDougall | 236/2 B |
| 3,414,014 | A | * | 12/1968 | Merchant etal. | 236/92 B |
| 4,106,691 | A | * | 8/1978 | Nielsen | 236/92 B |
| 4,342,421 | A | * | 8/1982 | Widdonson | 236/92 B |
| 4,372,486 | A | * | 2/1983 | Tomioka et al. | 236/92 B |
| 4,852,364 | A | | 8/1989 | Seener | 62/225 |
| 5,065,595 | A | * | 11/1991 | Seener et al. | 62/225 |
| 5,186,207 | A | * | 2/1993 | Kaneko et al. | 236/92 B |
| 5,251,459 | A | | 10/1993 | Grass | 62/324.1 |
| D359,114 | S | * | 6/1995 | Vestergaard | 236/92 B |
| 5,547,126 | A | * | 8/1996 | Bogrand, IV et al. | 236/92 B |

* cited by examiner

*Primary Examiner*—William E. Tapolcai
*Assistant Examiner*—Mohammad M. Ali
(74) *Attorney, Agent, or Firm*—Lee, Mann, Smith, McWilliams, Sweeney & Ohlson

(57) ABSTRACT

A thermal expansion valve body for a thermal expansion valve. In order to provide universality so that the thermal expansion valve can ultimately be formed with an inlet and outlet either being aligned or at an angle to one another, the thermal expansion valve body includes an inlet protrusion for the inlet an outlet protrusion for the outlet, and a bypass aperture protrusion for a bypass aperture. The outlet protrusion and the bypass protrusion are substantially identical such that the outlet can be formed in one the outlet and bypass protrusions, and the bypass aperture can be formed in the other of the outlet and bypass protrusions.

4 Claims, 4 Drawing Sheets

EXPANSION VALVE HOUSING

BACKGROUND OF THE INVENTION

This invention relates to thermal expansion valves, and in particular to thermal expansion valves in which the flow direction is reversible. In further particular, the invention relates to a thermal expansion valve body having universal outlet and bypass aperture protrusions such that the position of the outlet for the thermal expansion valve and the position of the bypass aperture of the thermal expansion valve can readily be switched when final formation takes place of the thermal expansion valve from the thermal expansion valve body.

Thermal expansion valves of the nature of the present invention are used in installations where the flow direction is reversible. For example, such valves are used in heat pump systems, where the flow direction is reversible so that the heat pump provides heating during cold weather and cooling during warm weather. There are generally two types of the thermal expansion valves, one in which the inlet and outlet of the thermal expansion valve are aligned in a straight line fashion, and another where the inlet and outlet are angled, normally at a right angle, to one another so that inlet and outlet flows are at an angle to one another. In the past, such valves have not been universal—two valve versions (and the resulting metal forging dies) are required for the two different thermal expansion valves.

Thermal expansion valves of the type of the present invention are disclosed in prior U.S. Pat. Nos. 4,852,364 and 5,251,459. In heat pump systems there are typically two expansion valves with bypass, being situated between an indoor coil and an outdoor coil. When the heat pump system operates in the heating mode cooled refrigerant leaves the indoor coil, bypasses the first expansion valve via the bypass, expands in the second expansion valve and evaporates in the outdoor coil. When the heat pump system is in the cooling mode the flow direction of the refrigerant is reversed and the refrigerant is condensed in the outdoor coil, and evaporates in the indoor coil. During the flow from indoor coil to outdoor coil the refrigerant bypasses the second expansion valve and is expanded by the second expansion valve. As is well known in the art, the thermal expansion valve includes an external or internal bypass which is utilized depending on the utilization of the thermal expansion valve in the heating cycle or the cooling cycle.

SUMMARY OF THE INVENTION

The invention is directed to a single thermal expansion valve body which can be used to create a thermal expansion valve, whether the inlet and outlet of the thermal expansion valve are aligned in a straight line fashion, or whether the inlet and the outlet are angled in relation to one another. The thermal expansion valve which is made from the thermal expansion valve body according to the invention includes an internal bypass, and further includes at least an inlet, an outlet, and a bypass aperture, with one of the outlet and the bypass aperture being aligned opposite the inlet and the other of the outlet and the bypass aperture being aligned at an angle to the inlet. The thermal expansion valve body includes a inlet protrusion for the inlet, an outlet protrusion for the outlet, and a bypass aperture protrusion for the bypass aperture. The outlet protrusion and the bypass aperture protrusion are substantially identical such that the outlet can be formed in either one of the outlet and bypass aperture protrusions and the bypass aperture can be formed in the other of the outlet and bypass aperture protrusions.

In accordance with the preferred form of the invention, the thermal expansion valve body also includes a pressure equalizing protrusion which can be used for formation of a pressure equalizing connection to the thermal expansion valve. Preferably, the pressure equalizing protrusion is opposite either the outlet protrusion or the bypass aperture protrusion.

Also in accordance with the preferred form of the invention, the outlet protrusion and the bypass aperture protrusion are aligned generally at an angle to one another, which angle is preferably a right angle. The outlet protrusion and the bypass aperture protrusion are located at equal distances from the top and bottom of the thermal expansion body.

Additionally, the outlet protrusion and the bypass aperture protrusion have substantially the same size, diameter, and height from the thermal expansion body. The protrusions are therefore the substantially identical, so that one or the other of the outlet and the bypass aperture can be formed in one or the other of the outlet and the bypass aperture protrusions.

By forming the thermal expansion valve body in accordance with the invention, only a single thermal expansion valve body need be provided, whether the ensuing thermal expansion valve has the inlet and outlet aligned opposite one another, or whether the inlet and the outlet are aligned at an angle to one another. Thus, the production expense of the thermal expansion valve is greatly reduced.

BRIEF DESCRIPTION OF THE DRAWINGS

The invention is described in greater detail in the following description of an example embodying the best mode of the invention, taking in conjunction with the drawing figures, in which.

DESCRIPTION OF AN EXAMPLE EMBODYING THE BEST MODE OF THE INVENTION

Figure 1:
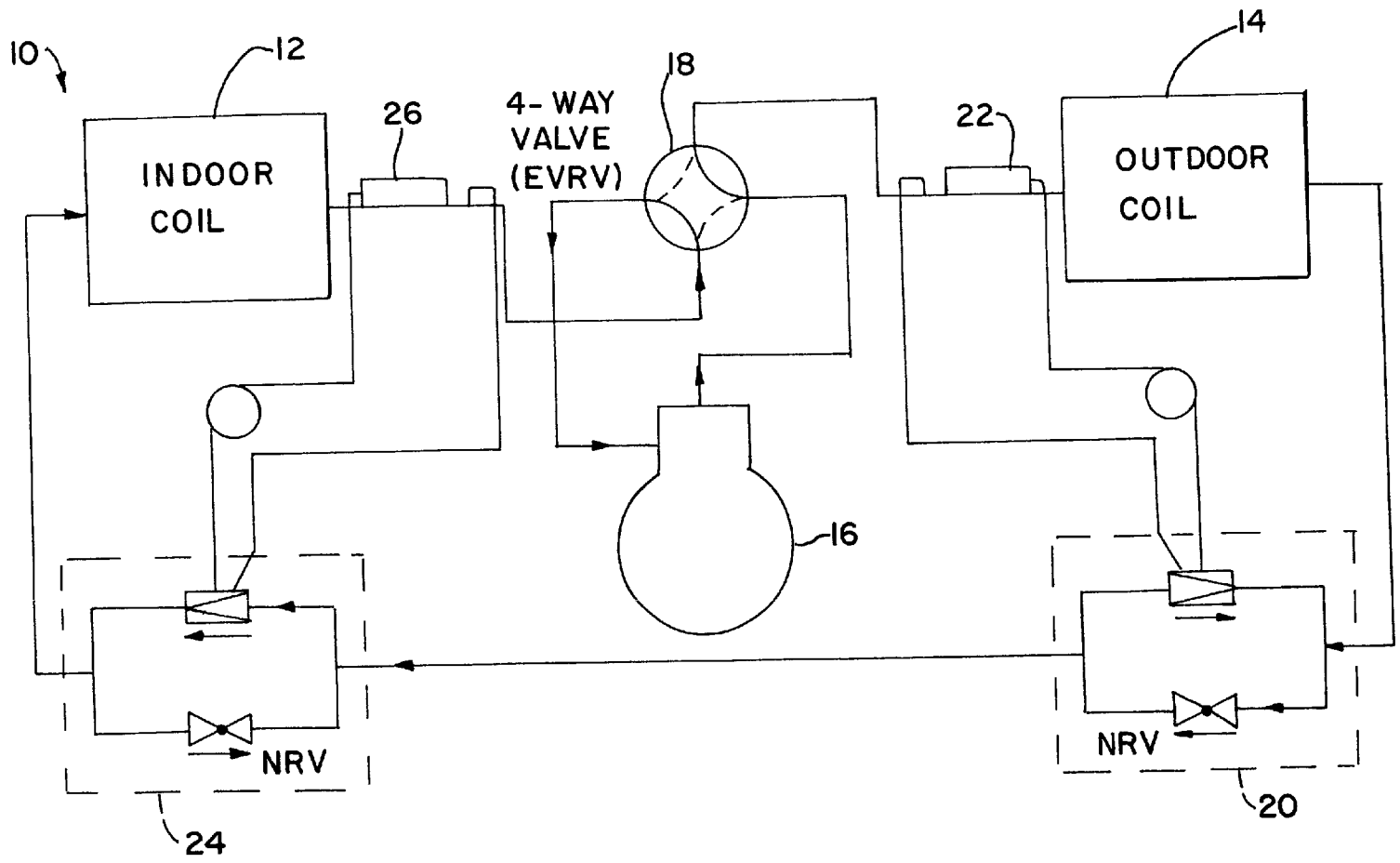
FIG. 1 is a schematic illustration of a typical reversible heat pump system employing a reversible thermal expansion valve.
Figure 2:
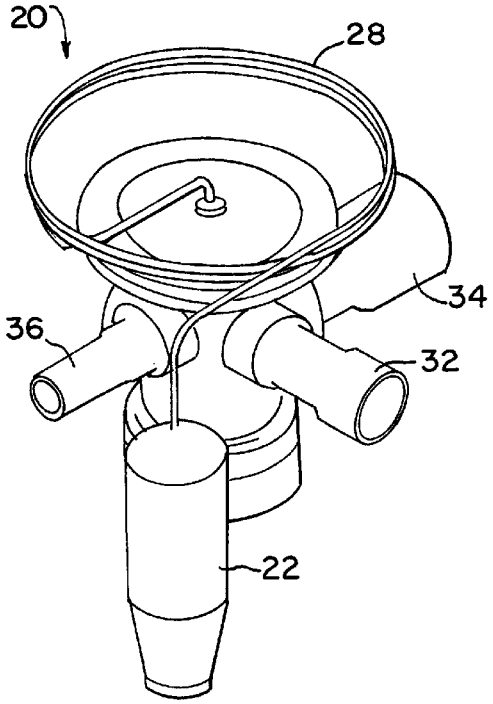
FIG. 2 is a perspective view of a thermal expansion valve according to the invention, having the inlet and the outlet at angle to one another.
Figure 3:
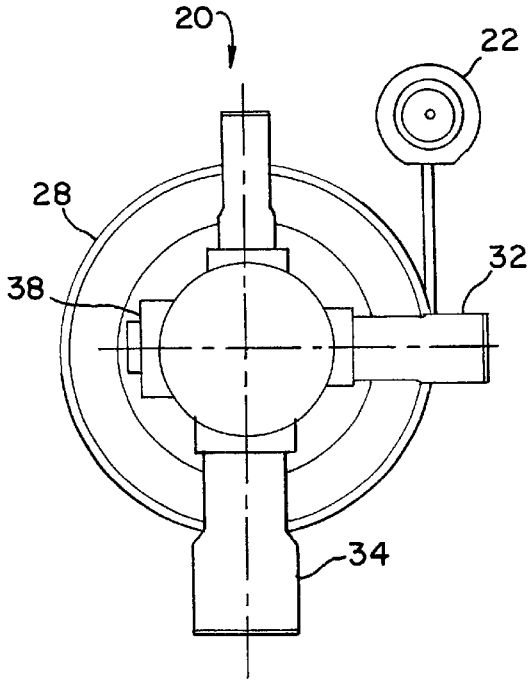
FIG. 3 is a bottom plan view of the type of thermal expansion valve illustrated in FIG. 2.

A typical heat pump system employing a thermal expansion valve according to the invention is shown generally at 10 in FIG. 1. The heat pump system 10 can be conventional, and is thus not described in particular detail. Further details for typical heat pump systems can be found in U.S. Pat. Nos. 4,852,364 and 5,251,459, the disclosures of which are incorporated herein by reference.

The heat pump system 10 employs two heat exchangers, an indoor coil 12 and an outdoor coil 14. A compressor 16 is employed to provide heated refrigerant to a four-way valve, whose position determines which of the coils 12 and 14 is utilized as the condenser, and which of the coils 12 and 14 is utilized as the evaporator. Also employed in the heat pump system 10 is a thermal expansion valve 20 in accordance with the invention, having a temperature sensing bulb 22. Finally, employed is a thermal expansion valve 24 having a temperature sensing bulb 26. All of what is illustrated in FIG. 1, with the exception of the body for the thermal expansion valve 20, may be conventional, and is therefore not described in greater detail.

Figure 6:
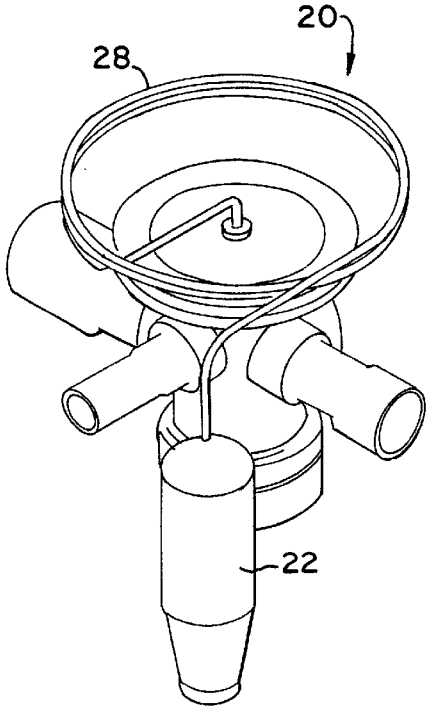
FIG. 6 is a perspective view of a thermal expansion valve similar to that of FIGS. 2–5, except with the inlet and the outlet are aligned opposite one another.
Figure 7:
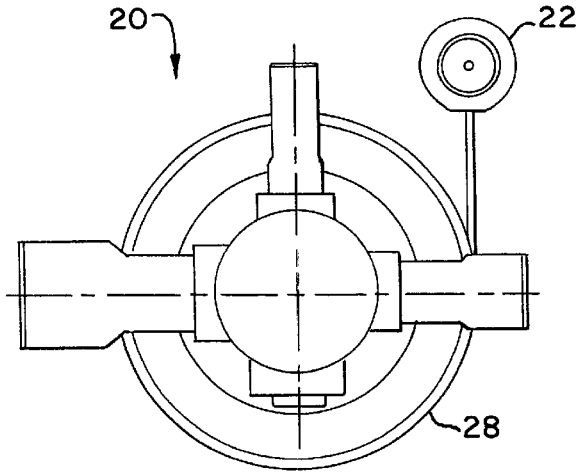
FIG. 7 is a bottom plan view of the type of thermal expansion valve according FIG. 6.
Figure 8:
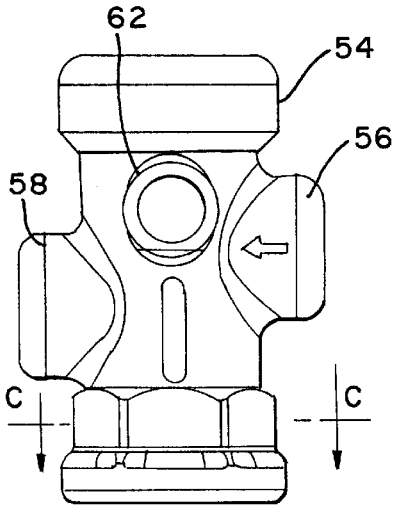
FIG. 8 is an elevational illustration of a thermal expansion valve body according to the invention, with the valve inlet protrusion at the right.
Figure 9:
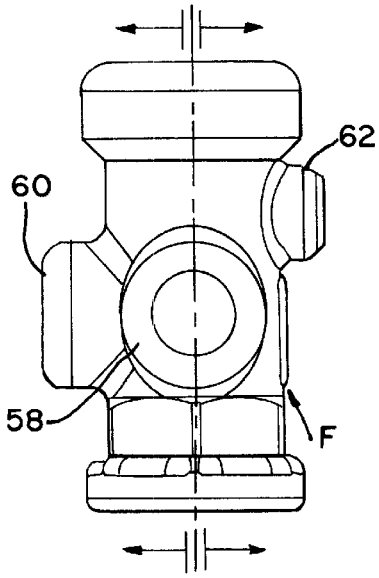
FIG. 9 is an elevational illustration of a thermal expansion valve body according to the invention, with the pressure equalizing protrusion at the right.
Figure 10:
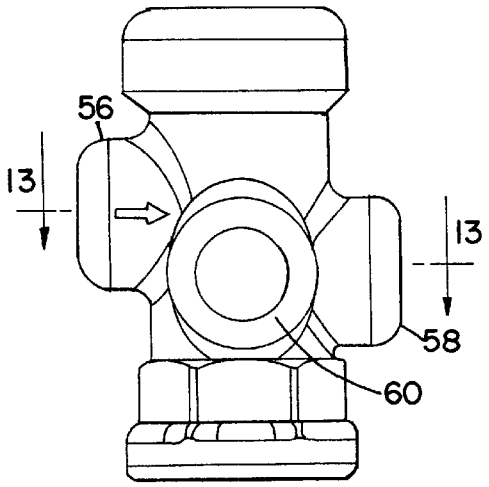
FIG. 10 is an elevational illustration of the thermal expansion valve body according to the invention, with the inlet protrusion at the left.
Figure 11:
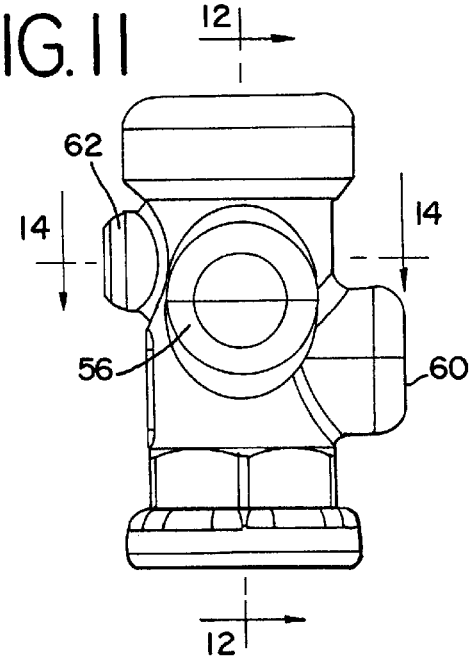
FIG. 11 is an elevational illustration of the thermal expansion valve body according to the invention, with the pressure equalizing protrusion at the left.
Figure 12:
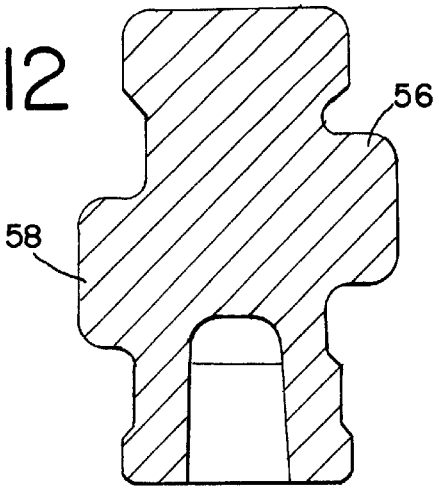
FIG. 12 is a cross-sectional illustration along lines 12—12 of FIG. 11.
Figure 13:
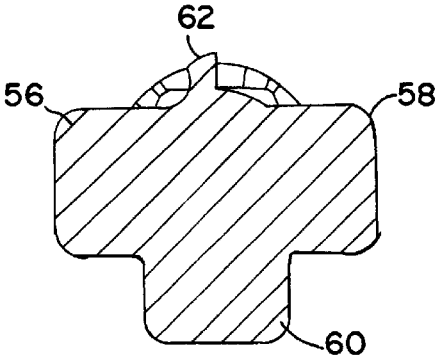
FIG. 13 is a cross-section illustration along lines 13—13 of FIG. 10
Figure 14:
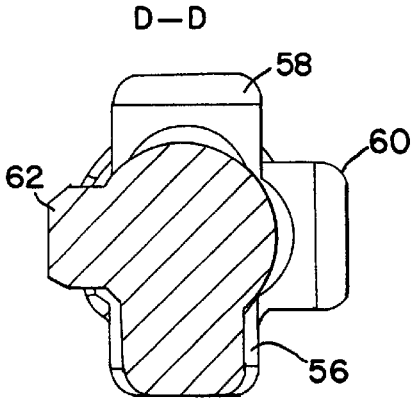
FIG. 14 is a cross-sectional illustration along lines 14—14 of FIG. 12.

One form of the thermal expansion valve 20 is illustrated in FIGS. 2–5. This version illustrates an inlet and outlet being aligned at an angle. A second version of the thermal expansion valve 20 is illustrated in FIGS. 6 and 7. That form is identical to the form illustrated in FIGS. 2–5, except that the inlet and outlet are aligned in a straight line orientation. The operation of the form illustrated in FIGS. 6 and 7 is identical to that to be described in relation to FIGS. 2–5, and therefore that illustrated in FIGS. 6 and 7 will not be described in detail. Common elements bear the same reference numerals throughout FIGS. 2–7.

Figure 4:
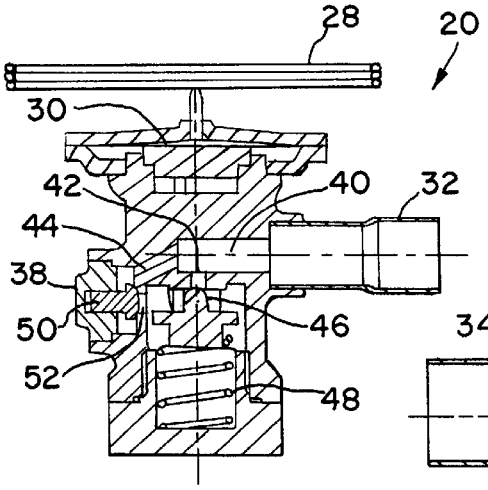
FIG. 4 is a cross-sectional illustration of the thermal expansion valve of FIG. 3, taken through valve inlet.
Figure 5:
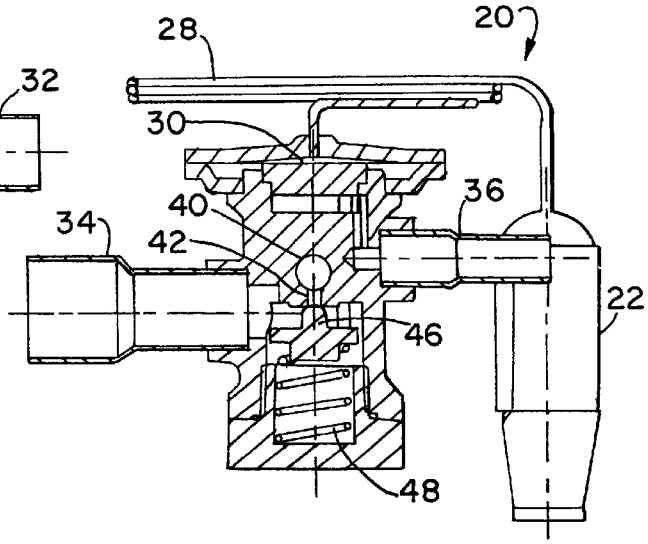
FIG. 5 is a cross-sectional illustration of the thermal expansion valve of FIG. 3, taken through the valve outlet.

The thermal expansion valve 20 has the temperature sensing bulb 22 connected thereto through a conduit 28. As illustrated in FIG. 4, the temperature sensed by the bulb 22 acts on a membrane 30 within the expansion valve 20 in a conventional fashion.

The expansion valve 20 includes an inlet 32, and outlet 34, a pressure equalization connection 36 and a bypass cover 38. It will be understood that the terms "inlet" and "outlet" are relative terms, in that when the flow direction is reversed, the inlet and the outlet are reversed, as well. For the purposes of description, however, and for operation with a normal flow, the inlet and outlet are as previously designated and illustrated in the drawing figures.

Internally, the expansion valve 20 includes an inlet bore 40 in communication with an expansion opening 42. The inlet bore 40 also communicates with a bypass bore 44. The expansion opening 42 is closed by a closure 46 which is biased in placed by a spring 48. A bypass closure 50 closes a bypass opening 52.

During normal operation, when the inlet 32 is connected as an inlet and the outlet 34 is connected as an outlet, relatively high pressure appears in the inlet bore 40. That high pressure is communicated through the bypass bore 44 against the back side of the bypass closure 50, thus maintaining the closure 50 in a seated relationship against the bypass opening 52. At the same time, the high pressure from the inlet bore 40 passes through the expansion opening 42, depressing the closure 46 against the force of the spring 48, allowing flow through the expansion opening 42 and to the outlet 34. When flow is reversed, high pressure appears in the outlet 34. That high pressure depresses the bypass closure 50, allowing refrigerant to flow through the bypass opening 52 to the bypass bore 44 and then to the inlet bore 40. The spring 48 maintains the closure 46 seated against the expansion opening 42. Thus, the expansion opening is bypassed when flow is reversed.

The housing or body of the thermal expansion valve 20 is preferably made of brass, and is produced in a hot forging process. In one such process, from a rod of brass, a suitable piece is severed and heated. The piece is then placed in a forging die which, under pressure, shapes the piece to substantially the form illustrated in FIGS. 8–14. Any surplus material is removed, resulting in the shape illustrated in FIGS. 8–14. The forging process can be conventional, and after the piece is forged into the shape illustrated in FIGS. 8–14, conventional milling can occur to provide appropriate passages for proper functioning of the expansion valve, as explained previously.

The body 54 illustrated in FIGS. 8–14 is provided with four protrusions 56, 58, 60, and 62. The protrusion 56 serves as the protrusion for forming of the inlet, while the protrusion 62 serves as the protrusion for forming of the pressure equalization connection. The protrusions 58 and 60 are, as illustrated, identical to one another, both in location relative to the top and bottom of the body 54, as well as in size, height and diameter. Thus, one of the protrusions 58 and 60 can be milled to perform as the outlet, while the other of the protrusions 58 and 60 can milled with an aperture to accommodate the bypass cover. For example, if a straight through orientation is desired with the inlet 32 in alignment with the outlet 34, the protrusion 58 is milled as the outlet protrusion, and the protrusion 60 is milled as the bypass cover protrusion. Conversely if the outlet is desired to be at an angle to the inlet, the protrusion 58 is milled as the bypass cover protrusion, and the protrusion 60 is milled as the outlet protrusion.

Thus, one body 54 can milled to produce a thermal expansion valve 20, whether the flow direction is to be in a straight line orientation, or whether the flow direction is be in an angle orientation. Two forging dies are therefore not required, reducing cost and complexity.

Various changes can be made to the invention without departing from the spirit thereof or scope of the following claims.

What is claimed:

1. A thermal expansion valve body for a thermal expansion valve having an internal bypass, the expansion valve also having at least an inlet, an outlet and a bypass aperture with one of the outlet and the bypass aperture being aligned opposite the inlet and the other of the outlet and the bypass aperture being aligned generally at an angle to the inlet, the thermal expansion valve body having an inlet protrusion for the inlet, an outlet protrusion for the outlet, and a bypass aperture protrusion for the bypass apertures the outlet protrusion and the bypass aperture protrusion being substantially identical such that the outlet can be formed in one of the outlet and bypass aperture protrusions and the bypass aperture can be formed in the other of the outlet and bypass aperture protrusions.

2. A thermal expansion valve body according to claim 1, including a pressure equalizing protrusion for formation of a pressure equalizing connection to the thermal expansion valve.

3. A thermal expansion valve body according to claim 1, in which the outlet protrusion and the bypass aperture protrusion are aligned generally at right angles to one another, and are located at equal distances from top and bottom of the thermal expansion valve body.

4. A thermal expansion valve body according to claim 1, in which the outlet protrusion and the bypass aperture protrusion have substantially the same size, diameter and height from the thermal expansion valve body.

* * * * *